US007025609B2

(12) United States Patent
Matsumoto et al.

(10) Patent No.: US 7,025,609 B2
(45) Date of Patent: Apr. 11, 2006

(54) ELECTRICAL CONNECTOR WITH SHUTTER MEMBER

(75) Inventors: Yasuyoshi Matsumoto, Yamato (JP); Mitsuhiro Tomita, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/512,532

(22) PCT Filed: Apr. 30, 2003

(86) PCT No.: PCT/US03/13660

§ 371 (c)(1),
(2), (4) Date: May 25, 2005

(87) PCT Pub. No.: WO03/094294

PCT Pub. Date: Nov. 13, 2003

(65) Prior Publication Data

US 2005/0233623 A1 Oct. 20, 2005

(30) Foreign Application Priority Data

Apr. 30, 2002 (JP) ..... 2002-127732

(51) Int. Cl.
*H01R 13/44* (2006.01)

(52) U.S. Cl. ..... 439/138; 385/60

(58) Field of Classification Search ..... 439/138, 439/142; 385/78, 60
See application file for complete search history.

(56) References Cited

U.S. PATENT DOCUMENTS

| | | | | |
|---|---|---|---|---|
| 5,687,268 | A * | 11/1997 | Stephenson et al. | 385/73 |
| 5,980,279 | A * | 11/1999 | Muller | 439/142 |
| 6,457,843 | B1 * | 10/2002 | Kester et al. | 362/276 |
| 6,679,710 | B1 * | 1/2004 | Saito et al. | 439/142 |
| 2001/0009598 | A1 * | 7/2001 | Ohbayashi et al. | 385/78 |
| 2002/0118931 | A1 * | 8/2002 | Ohbayashi et al. | 385/88 |
| 2005/0129354 | A1 * | 6/2005 | Eggert et al. | 385/19 |

* cited by examiner

*Primary Examiner*—Phuong Dinh
(74) *Attorney, Agent, or Firm*—Charles S. Cohen

(57) ABSTRACT

An electrical connector includes a dielectric housing having a receptacle for receiving a complementary mating connecting device. A shutter is pivotally mounted on the housing for pivotal movement in an angular range between a closed position blocking the receptacle and an open position allowing mating of the complementary mating connecting device. The shutter includes a pivot shaft insertable transversely into a bearing hole in the housing. The bearing hole has a given width and a restricted mouth of a width less than the given width. The pivot shaft has a major cross-dimension for rotation in the bearing hole and a minor cross-dimension for insertion through the restricted mouth to allow the pivot shaft to be inserted transversely into the bearing hole.

5 Claims, 7 Drawing Sheets

ELECTRICAL CONNECTOR WITH SHUTTER MEMBER

FIELD OF THE INVENTION

This invention generally relates to the art of electrical connectors and, particularly, to an electrical connector which includes a shutter member for closing a mating receptacle of the connector.

BACKGROUND OF THE INVENTION

Many electrical connectors include a dielectric housing having an opening or receptacle for receiving a complementary mating connector or other mating connecting device. A plurality of conductive terminals have contact portions exposed at or in the receptacle for engaging appropriate contacts of the mating connector. Other protectible components also may be exposed in the receptacle. Examples of such connectors are a memory card connector which has a receptacle for receiving a memory card or a flat circuit connector having a receptacle for receiving a flat flexible circuit, a flexible printed circuit or the like.

One of the problems with electrical connectors having receptacles that expose terminals or other components is that the contact portions of the terminals, for instance, may be engaged by an operator's fingers or other foreign objects which may cause damage to or deformation of the terminals. In order to alleviate these problems, some such electrical connectors are provided with protective covers or shutters which close the mating receptacle and which are movable to open positions during mating. For instance, such shutters are shown in Japanese Unexamined Utility Model Publication No. 5-23446, Japanese Unexamined Patent Publication No. 9-266028 and Japanese Patent No. 2601801.

In shutter-type connectors as described above, the shutter may be pivotally mounted at the receptacle by a hinge means which includes a pivot shaft of metal or like material as an independent part. Unfortunately, such separate pivot shafts increase the costs of the connector, include an additional assembly step and the shaft must be maintained in inventory.

If the pivot shaft is integral with the shutter or the connector housing at the receptacle in order to reduce the number of parts, the shaft typically is forcibly inserted into a bearing hole during assembly. This type of structure is prone to causing breakage of the shaft, and the assembly procedure often is difficult. If the pivot shaft is inserted into a narrowed insertion groove of the bearing hole, the shaft has a tendency to pull out of the hole during repeated usage. The present invention is directed to a shutter-type system which solves these various problems.

SUMMARY OF THE INVENTION

An object, therefore, of the invention is to provide a new and improved electrical connector having an improved shutter system.

In the exemplary embodiment of the invention, an electrical connector includes a dielectric housing having a receptacle for receiving a complementary mating connecting device. A plurality of conductive terminals are mounted on the housing and have contact portions exposed in the receptacle for engaging appropriate contacts of the mating connecting device. A shutter is pivotally mounted on the housing by pivot means providing pivotal movement of the shutter in an angular range between a closed position blocking the receptacle to prevent inadvertent engagement of foreign objects with the contact portions of the terminals and an open position allowing mating of the complementary mating connecting device.

The invention contemplates that the pivot means for the shutter include a bearing hole in the housing. The bearing hole has a given width and a restricted mouth of a width less than the given width. A pivot shaft is provided on the shutter and is pivotally positionable in the bearing hole. The pivot shaft has a major cross-dimension less than the given width of the bearing hole but greater than the width of the restricted mouth, whereby the shutter can pivot between the closed and open positions. The pivot shaft has a minor cross-dimension less than the width of the restricted mouth to allow the pivot shaft to be inserted into the bearing hole, but the minor cross-dimension is not aligned with the mouth when the shutter pivots in said angular range between the closed and open positions.

As disclosed herein, the shutter is elongated. A pair of the bearing holes and a respective pair of the pivot shafts are located at opposite ends of the shutter.

According to one aspect of the invention, the restricted mouth of the bearing hole is located such that the pivot shaft is inserted into the bearing hole outside the angular range of pivotal movement of the shutter between the closed and open positions. Stop means are provided to prevent pivotal movement of the shutter beyond the angular range after the pivot shaft is inserted into the bearing hole. As disclosed herein, the stop means include a flexible arm on the housing engageable with a stop shoulder on the shutter. The flexible arm flexes to allow the pivot shaft to be inserted into the bearing hole, and the flexible arm snaps into stopping engagement with the stop shoulder when the shutter is pivoted into the angular range.

According to another aspect of the invention, anti-overstress means are provided to allow the stop means to resiliently yield if excessive forces are applied to the shutter in an attempt to pivot the shutter beyond the angular range. As disclosed herein, the anti-overstress means is provided by the same flexible arm which provides the stop means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
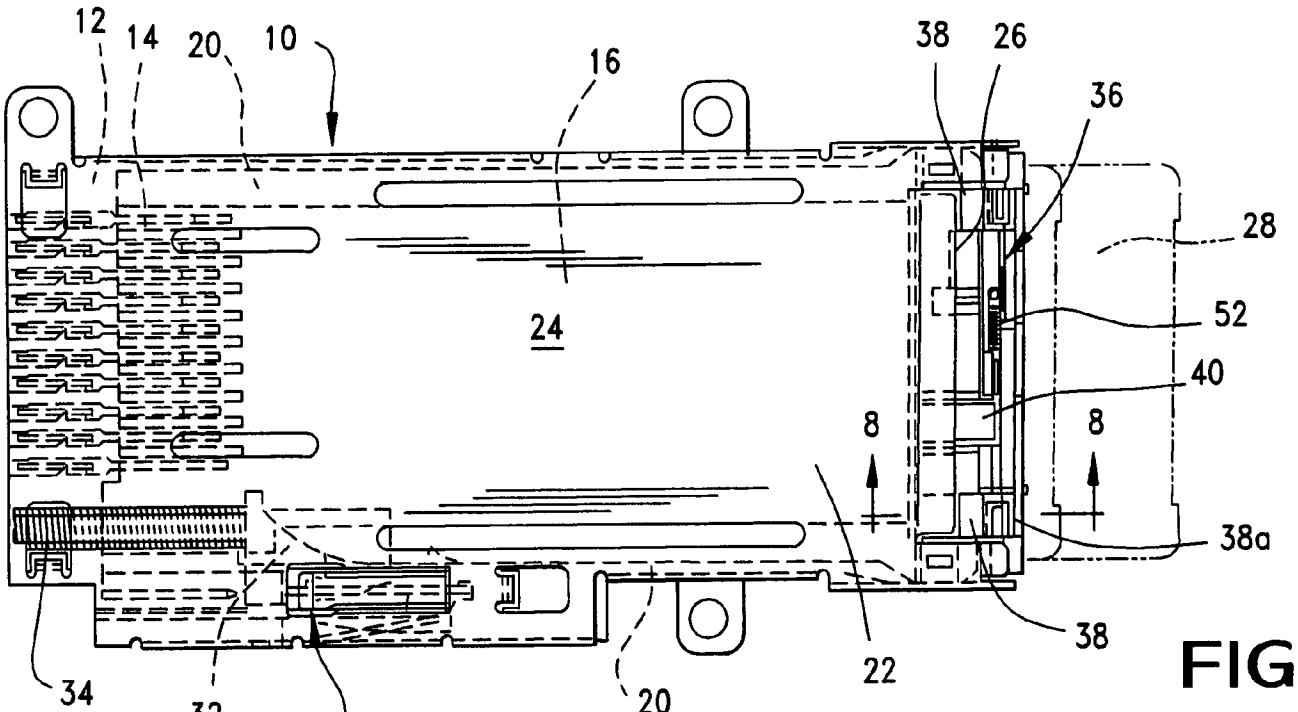
FIG. 1 is a top plan view of an electrical connector within which the invention is incorporated.
Figure 3:
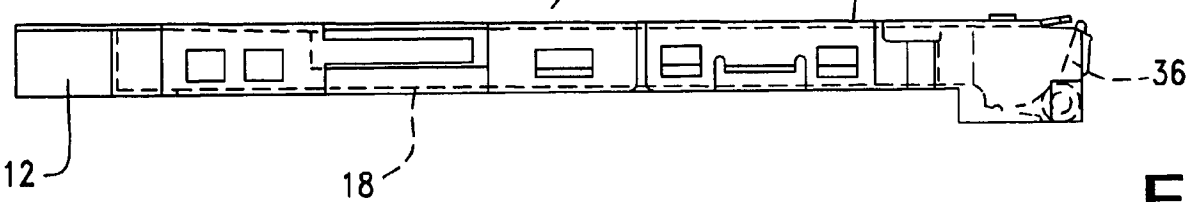
FIG. 3 is a side elevational view of the connector, looking at the bottom side thereof as viewed in FIG. 1.
Figure 2:
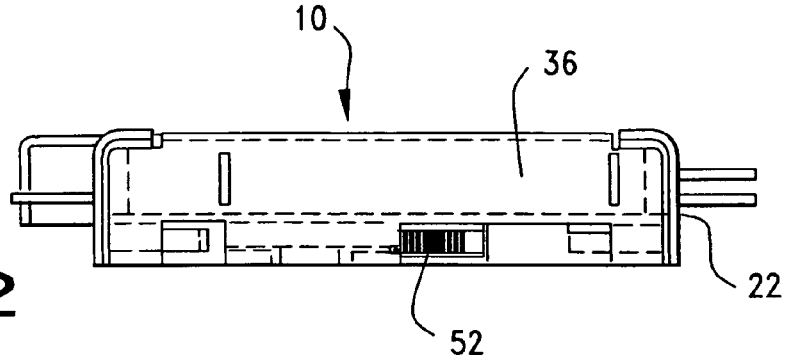
FIG. 2 is a front elevational view of the connector.
Figure 4:
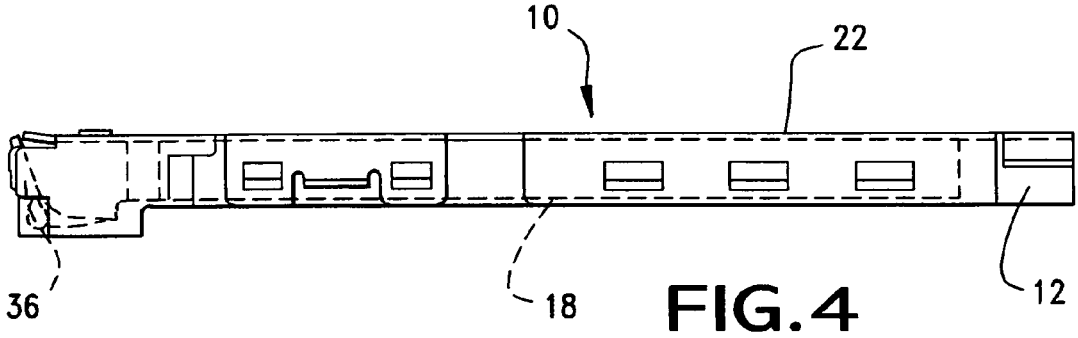
FIG. 4 is a side elevational view of the connector opposite that of FIG. 3.

Referring to the drawings in greater detail, and first to FIGS. 1–4, the invention is incorporated in an electrical connector in the form of a memory card connector, generally designated 10. However, it should be emphatically understood that the shutter concepts of the invention herein are equally applicable to a wide variety of other types of electrical connectors. With that understanding, connector 10 includes a dielectric housing 12 which mounts a plurality of terminals 14 at the extreme inner end of an interior card-receiving cavity 16. The housing has a bottom wall 18 and a pair of side walls 20. A metal shell 22 is mounted over the housing and includes a top plate 24. In essence, the bottom and side walls of the housing combine with top plate 24 of the metal shell to define the interior card-receiving cavity 16. A front opening or receptacle 26 receives a memory card 28 for insertion into the cavity whereby contacts on the memory card are engageable with terminals 14 within the rear end of the cavity.

Still referring to FIG. 1, an eject mechanism, generally designated 30, is provided for ejecting memory card 28. The eject mechanism is of fairly conventional construction and includes a cam slider 32 engageable with and movable with the memory card. The eject mechanism operates against a coil spring 34. Since the eject mechanism, per se, may be constructed by any known construction, a detailed discussion thereof will not be presented herein.

Figure 5:
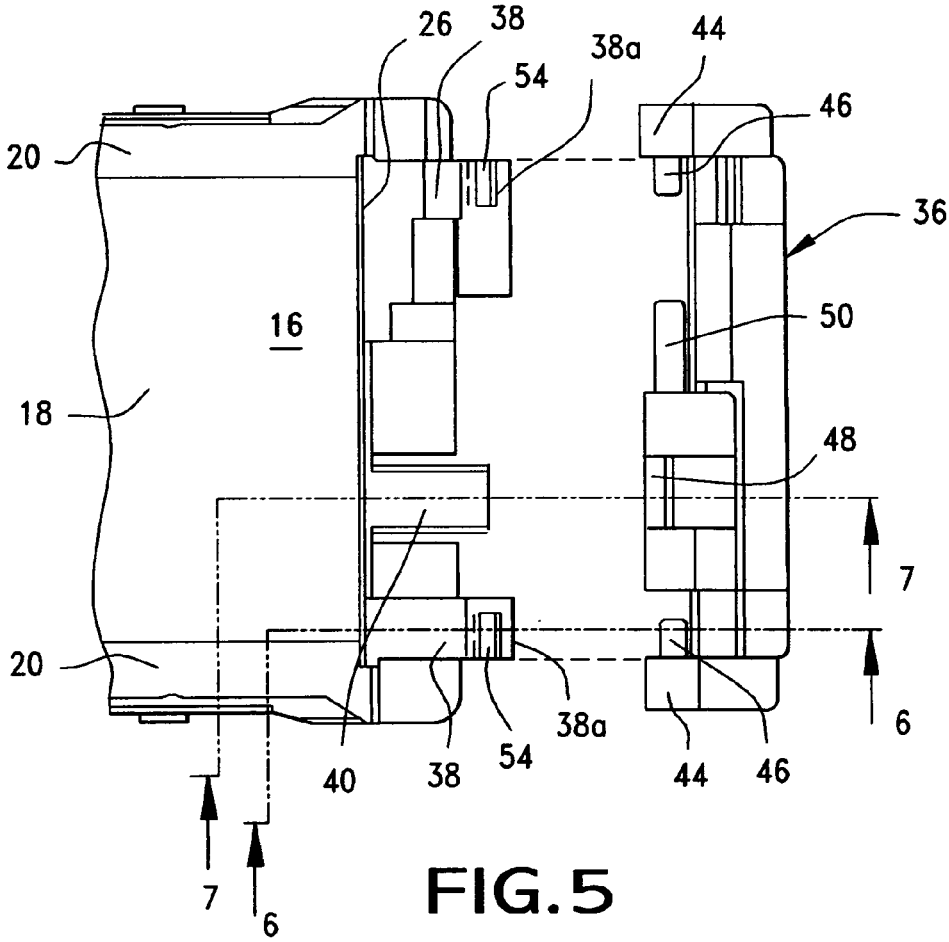
FIG. 5 is an enlarged top plan view of the receptacle end of the connector, with the shutter shown removed from the connector housing.
Figure 8:
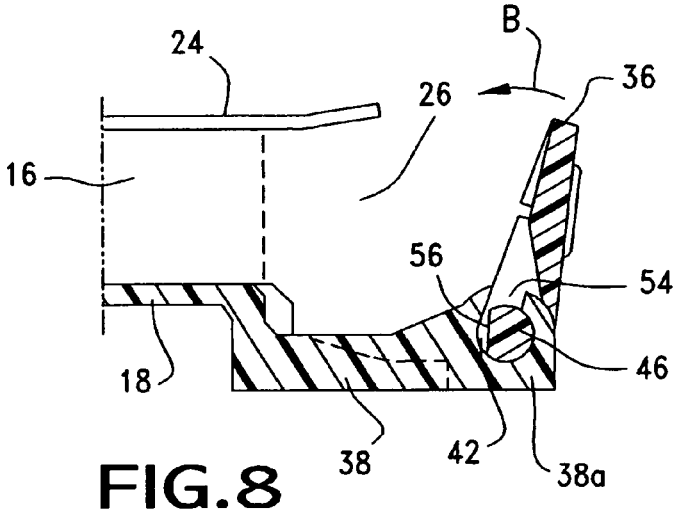
FIG. 8 is an enlarged vertical section taken generally along line 8—8 of FIG. 1, showing the shutter in its closed or blocking position.

FIG. 5 is an enlarged plan view of the front end of the connector, including receptacle 26 leading to card-receiving cavity 16 between bottom wall 18 and side walls 20 of the housing, with the metal shell removed to facilitate the illustration. An elongated shutter, generally designated 36, is pivotally mounted on the connector housing at the front end thereof for pivotal movement in an angular range between a blocking or closed position shown in FIG. 8, blocking receptacle 26 to prevent inadvertent engagement of foreign objects with the terminals, and an open position shown in phantom in FIG. 9, allowing insertion of memory card 28 into cavity 16.

Figure 6:
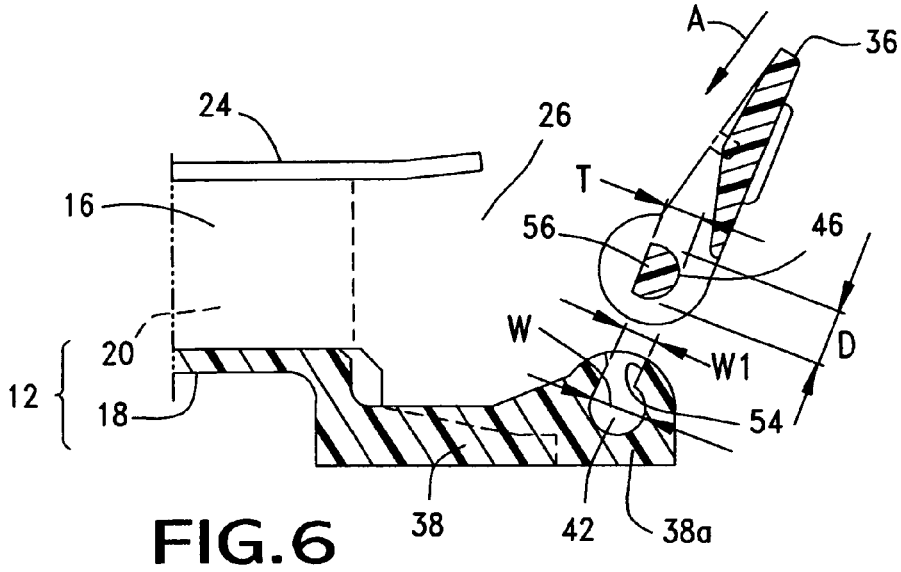
FIG. 6 is a vertical section taken generally along line 6—6 of FIG. 5.
Figure 7:
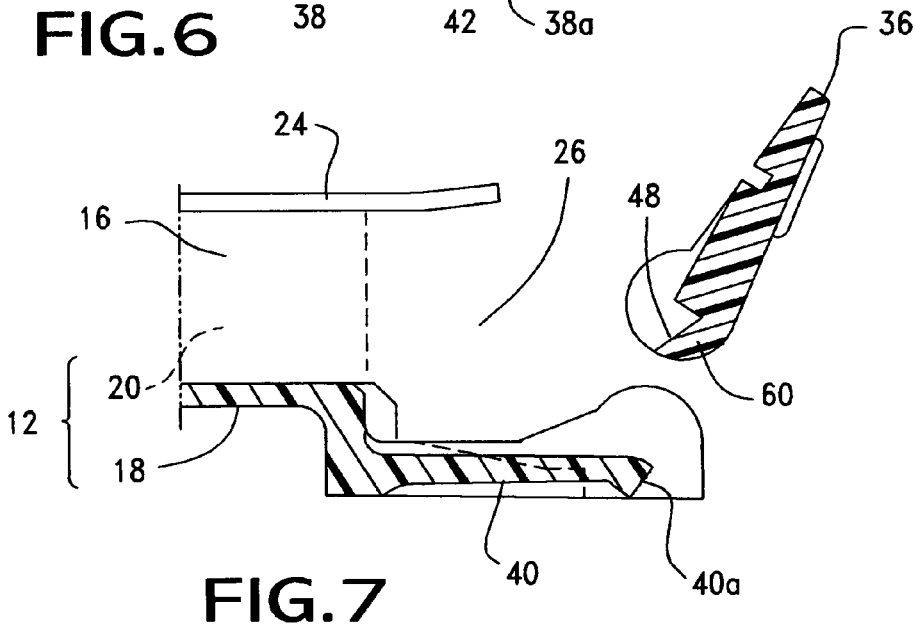
FIG. 7 is a view similar to that of FIG. 6 but taken generally along line 7—7 of FIG. 5.

Referring specifically to FIGS. 5–7, a pair of support plates 38 project forwardly or outwardly from the housing generally as extensions of bottom wall 18 of the housing as seen best in FIG. 6. A stop arm 40 also projects outwardly from the bottom wall as seen in FIG. 7, between support plates 38 as seen in FIG. 5. Each support plate 38 has a circular or cylindrical bearing hole 42 (FIG. 6) and stop arm 40 has a stop surface 40*a* (FIG. 7) at a distal end of the flexible stop arm.

FIG. 5 shows that elongated shutter 36 has a pair of side wings 44. A pivot shaft 46 projects inwardly from each side wing 44. As will be seen hereinafter, pivot shafts 46 pivotally mount shutter 36 by inserting the pivot shafts into bearing holes 42. The shutter includes a stop shoulder 48 for engaging stop surface 40*a* of resilient stop arm 40 as will be described hereinafter. Finally, shutter 36 includes a spring post 50 about which is wrapped a torsion coil spring 52 (FIG. 1) for biasing the shutter to its closed or blocking position.

Referring specifically to FIG. 6, it can be seen that each bearing hole 42 is generally circular or cylindrical and has a given width "W". The bearing hole is in a bearing portion 38*a* at a distal end of the respective support plate 38. The bearing hole has a restricted mouth 54 which has a width "W1" less than the given width of the bearing hole. Each pivot shaft 46 also is generally cylindrical or circular in cross-section. The shaft has a major cross-dimension "D" defined by the normal diameter of the cylindrical shaft and which is slightly less than given width "W" of bearing hole 42 so that the shaft easily pivots within the hole to pivotally mount the shutter to the connector housing. Each pivot shaft 46 has a flat side 56 which defines a minor cross-dimension "T" which is slightly less than the width "W1" of restricted mouth 54 of the bearing hole. Therefore, when shutter 36 is oriented as shown in FIG. 6, the shutter can be moved in the direction of arrow "A" to move pivot shaft 46 through restricted mouth 54 and into bearing hole 42. Once so inserted, the shutter is pivoted slightly in the direction of arrow "B" in FIG. 8, whereby the minor cross-dimension of the pivot shaft is no longer aligned with restricted mouth 54 and whereby the pivot shaft cannot be pulled out of the bearing hole because the major cross-dimension "D" of the shaft is greater than the width "W1" of restricted mouth 54.

Figure 9:
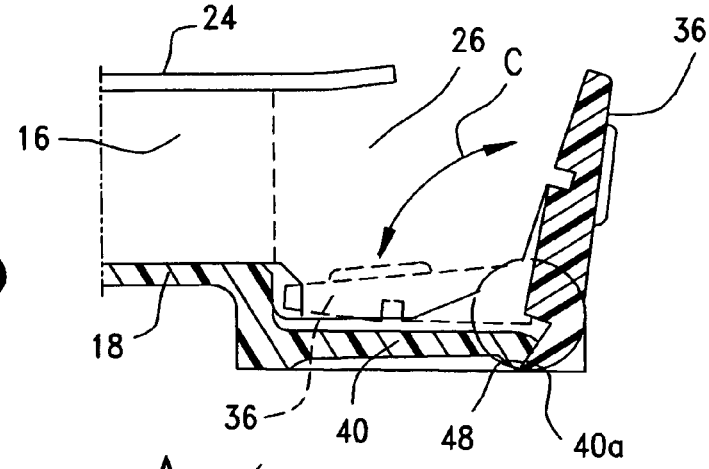
FIG. 9 is a view similar to that of FIG. 8, showing the range of pivotal movement of the shutter between its closed and open positions.

FIG. 9 shows shutter 36 in full lines in its blocking or closed position. The "angular range" of movement of the shutter is shown by double-headed arrow "C". In the blocking or closed position of the shutter, stop shoulder 48 on the shutter engages stop surface 40*a* at the distal end of stop arm 40. In the open position of the shutter shown in phantom in FIG. 9, the shutter abuts against the top of stop arm 40, exposing receptacle 26 to allow memory card 28 (FIG. 1) to be inserted through the receptacle and into interior card-receiving cavity 16.

Figure 10:
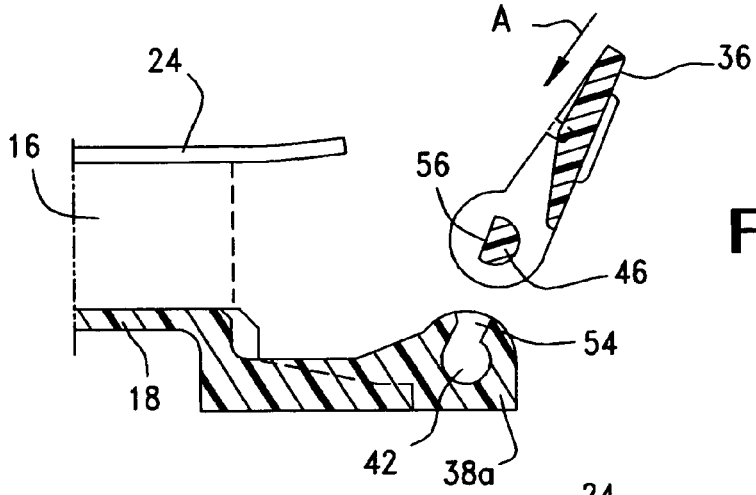
FIGS. 10–14 are sequential views of assembly of the shutter to the connector housing and taken in the area of the pivot means for the shutter.
Figure 11:
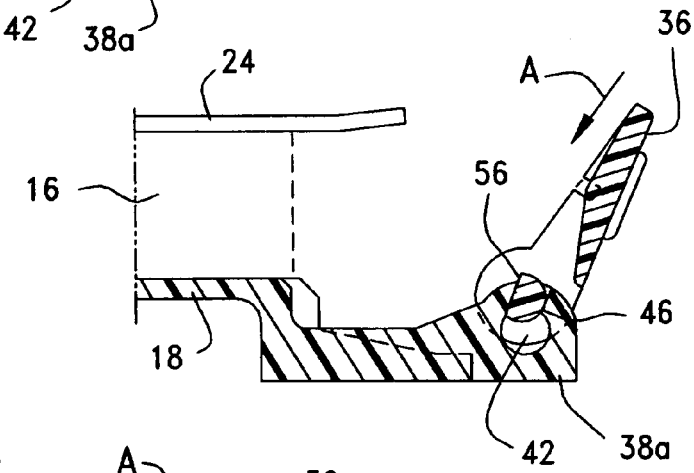
Figure 12:
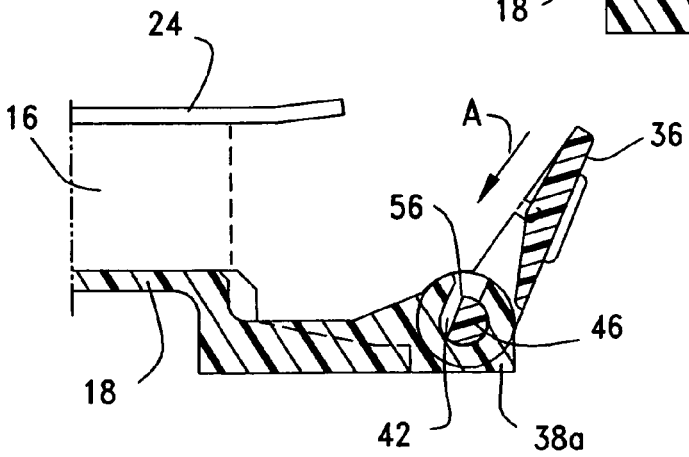
Figure 13:
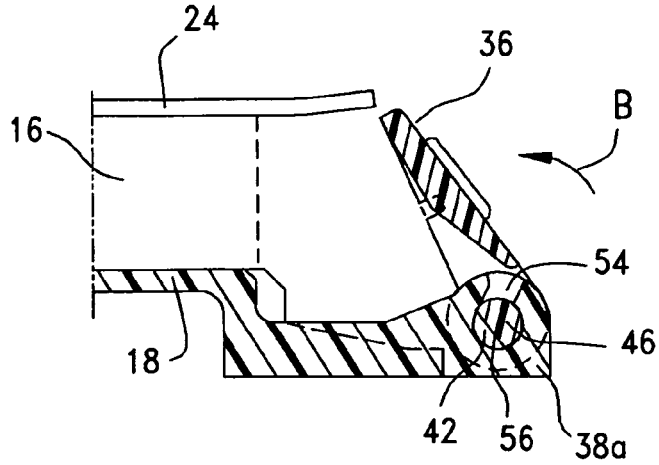
Figure 14:
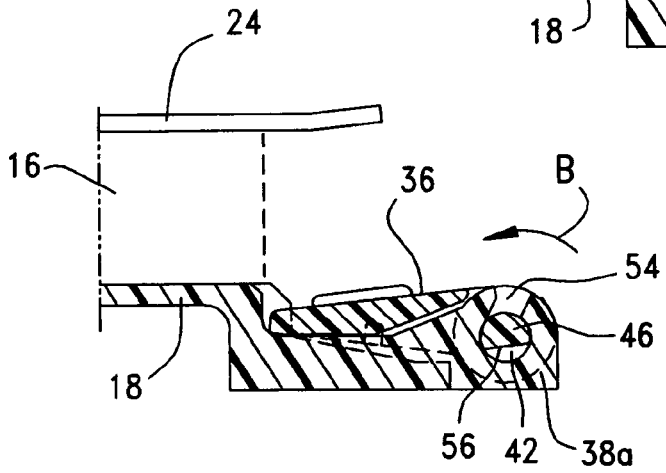
Figure 15:
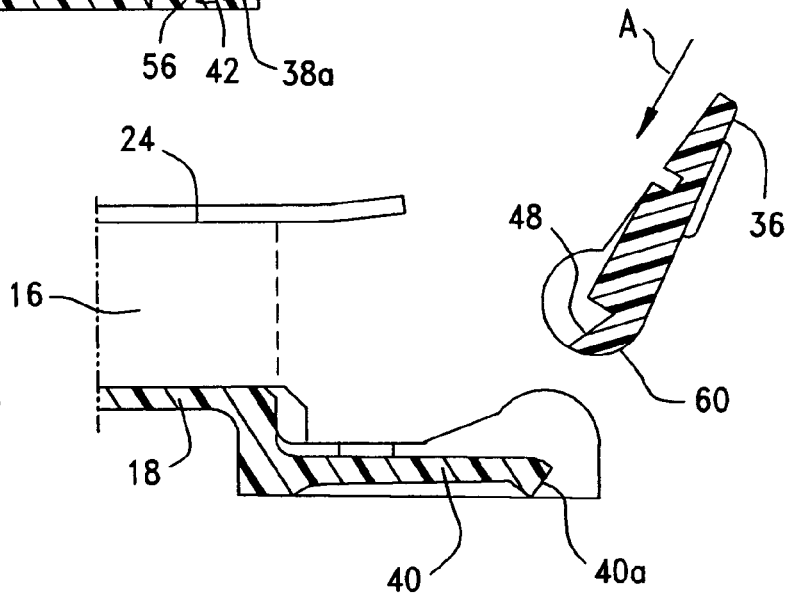
FIGS. 15–19 are sequential views similar to that of FIGS. 10–14, respectively, but taken in the area of the stop means for the shutter.
Figure 16:
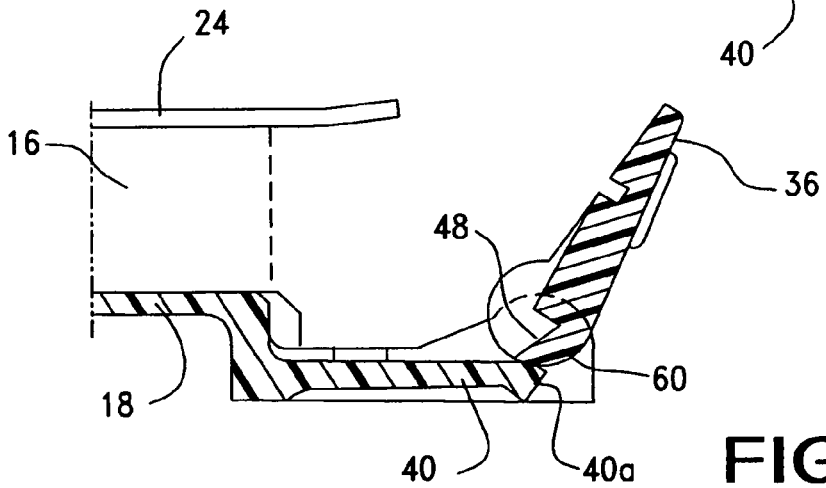
Figure 17:
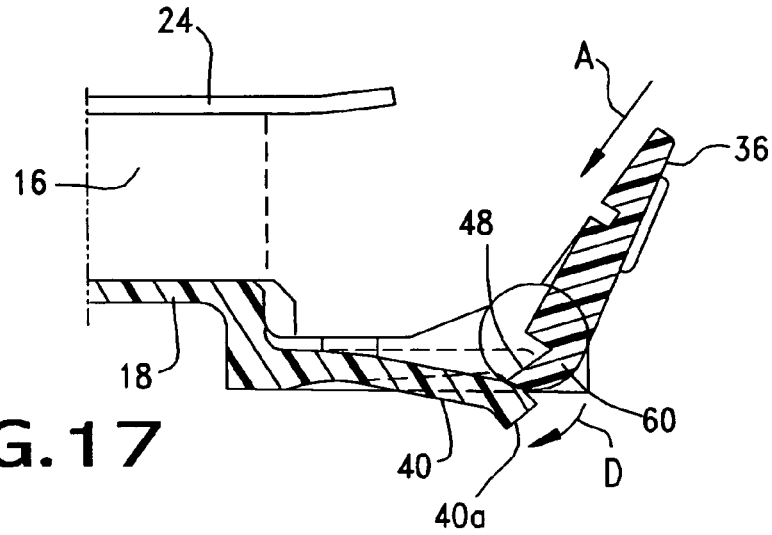
Figure 18:
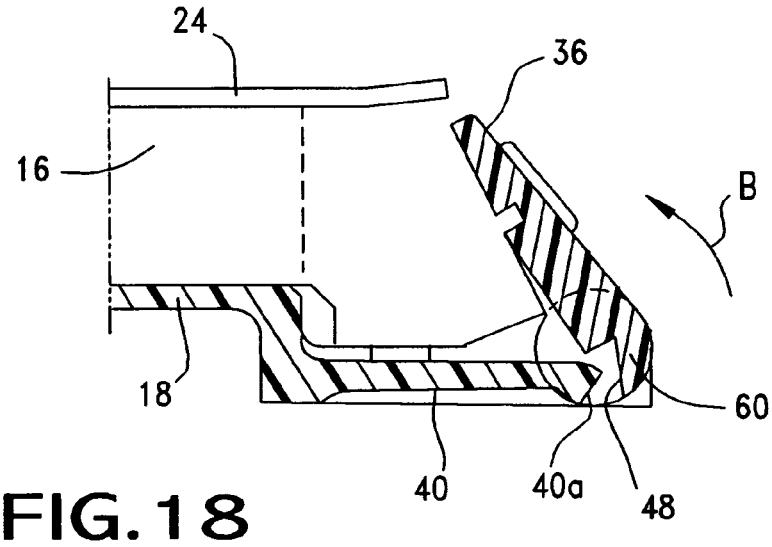
Figure 19:
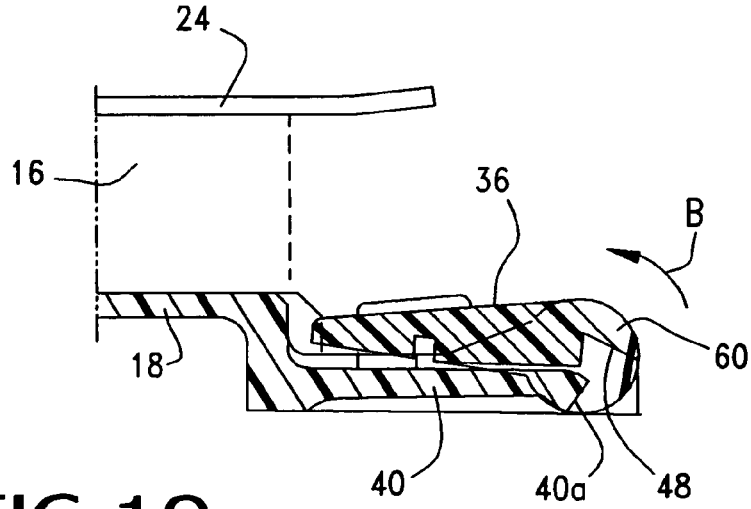

FIGS. 10–14 show sequential views of assembling shutter 36 to the connector. The shutter is oriented as shown in FIG. 10 and moved downwardly in the direction of arrows "A" in FIGS. 10–12 to move pivot shafts 46 into the bearing holes. In the orientation of the shutter in FIGS. 10–12, the minor-dimension "T" (FIG. 6) of the pivot shafts are aligned with restricted mouths 54 of bearing holes 42 so that the pivot shafts can pass through the restricted mouths and into the bearing holes. The shutter then can be pivoted in the direction of arrows "B" (FIGS. 13 and 14), whereupon the pivot shafts cannot be pulled back out through restricted mouths 54 because the major cross-dimension "D" (FIG. 6) of the pivot shafts are greater than the width of the restricted mouths.

FIGS. 15–19 correspond sequentially to FIGS. 10–14, but FIGS. 15–19 are taken in the area of the stop means which prevents the shutter from being pivoted beyond its normal angular range including the blocking position of the shutter. Specifically, as the shutter is moved into assembled condition in the direction of arrows "A" in FIGS. 15–17, corresponding to the movement of the shutter described above in relation to FIGS. 10–12, a rounded abutment end 60 of the shutter engages the top of resilient stop arm 40 at the distal end thereof. The resilient stop arm flexes downwardly in the direction of arrow "D" in FIG. 17 until stop shoulder 48 on the shutter clears the distal end of the flexed stop arm and snaps into engagement with stop surface 40*a* of the arm. As the shutter is pivoted in the direction of arrow "B" shown in FIGS. 18 and 19 and corresponding to the motion described above in relation to FIGS. 12 and 13, the distal end of resilient stop arm 40 is free of abutment end 60 of the shutter whereby the resilient stop arm returns back to its position shown in FIGS. 18 and 19, with stop surface 40*a* in position for engaging stop shoulder 48 of the shutter when the shutter moves back outwardly to its closed or blocking position.

Figure 20:
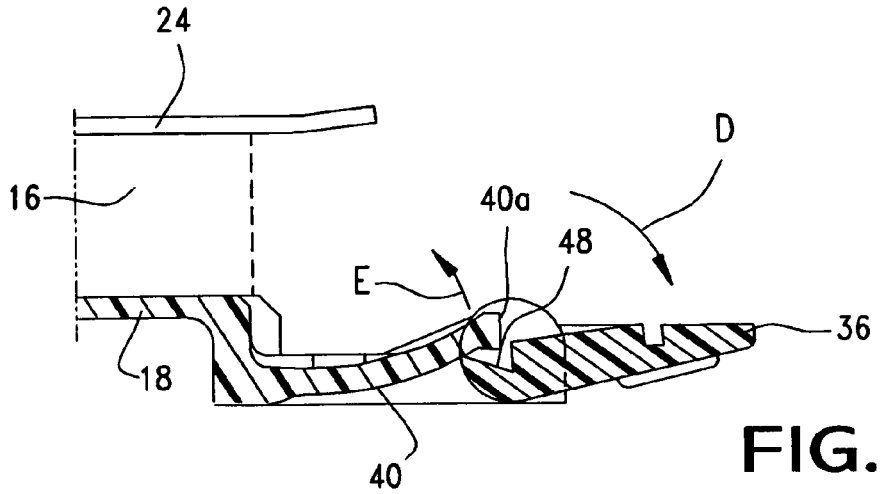
FIGS. 20 and 21 are views showing how the stop means for the shutter performs a dual function of an anti-overstress means therefor.
Figure 21:
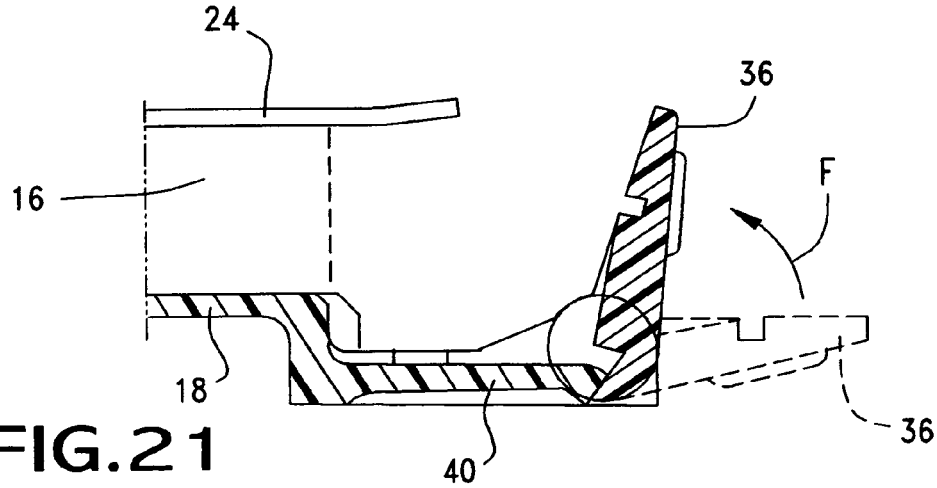

FIGS. 20 and 21 show a feature whereby resilient stop arm 40 performs a dual function of providing an anti-overstress means should shutter 36 be forced outwardly in the direction of arrow "D" (FIG. 20). When the shutter is improperly rotated outwardly in the direction of arrow "D", stop shoulder 48 on the shutter pushes upwardly on resilient stop arm 40 and the stop arm yields upwardly in the direction of arrow "E". When the shutter is released, the shutter springs back upwardly in the direction of arrow "F" (FIG. 21) under the influence of resilient stop arm 40 until the stop arm and shutter are back in their respective positions corresponding to the closed or blocking position of the shutter shown in FIG. 21.

Figure 22:
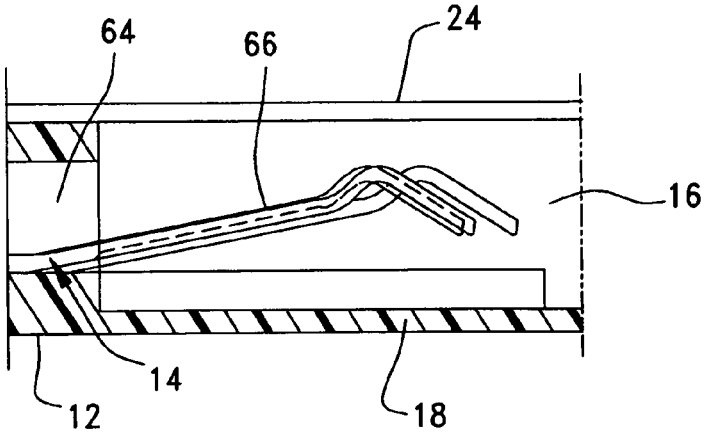
FIG. 22 is a fragmented section showing the interior terminals of the connector.

Finally, FIG. 22 simply shows that terminals 14 are mounted in passages 64 of connector housing 12. The terminals have flexible contact arms 66 projecting forwardly into interior card-receiving cavity 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector (10), comprising:

a dielectric housing (12) having a receptacle (26) for receiving a complementary mating connecting device (28);

a plurality of conductive terminals (14) mounted on the housing and having contact portions (66) exposed in the receptacle for engaging appropriate contacts of the mating connecting device;

a shutter (36) pivotally mounted on the housing by pivot means (42,46) providing pivotal movement of the shutter in an angular range (C) between a closed position blocking the receptacle (26) to prevent inadvertent engagement of foreign objects with the contact portions of the terminals and an open position allowing mating of the complementary mating connecting device;

said pivot means including a bearing hole (42) in the housing, the bearing hole having a given width (W) and a restricted mouth (54) of a width (W1) less than said given width, and a pivot shaft (46) on the shutter (36) and pivotally positionable in said bearing hole (42), the pivot shaft having a major cross-dimension (D) less than said given width (W) of the bearing hole (42) but greater than the width (W1) of said restricted mouth (54) whereby the shutter can pivot between said dosed and open positions, and the pivot shaft (46) having a minor cross-dimension (T) less than the width (W1) of said restricted mouth (54) to allow the pivot shaft to be inserted into the bearing hole and rotated so that the major cross-dimension of the shaft is aligned with the restricted mouth to prevent the shaft from moving out of the bearing hole;

stop means (40,40*a*,48) to prevent pivotal movement of the shutter (36) beyond said angular range (C) after the pivot shaft (46) is inserted into the bearing hole (42); and anti-overstress means (40) to allow said stop means (40*a*) to resiliently yield if excessive forces are applied to the shutter in an attempt to pivot the shutter (36) beyond said angular range, at least a portion (40) of said anti-overstress means being formed by a portion of said stop means.

2. The electrical connector of claim 1 wherein said shutter (36) is elongated and including a pair of said bearing holes (42) and a respective pair of said pivot shafts (46) at opposite ends of the shutter.

3. An electrical connector (10), comprising:

a dielectric housing (12) having a receptacle (26) for receiving a complementary mating connecting device (28);

a plurality of conductive terminals (14) mounted on the housing and having contact portions (66) exposed in the receptacle for engaging appropriate contacts of the mating connecting device;

a shutter (36) pivotally mounted on the housing by pivot means (42,46) providing pivotal movement of the shutter in an angular range (C) between a closed position blocking the receptacle (26) to prevent inadvertent engagement of foreign objects with the contact portions of the terminals and an open position allowing mating of the complementary mating connecting device;

stop means (40,40*a*,48) to prevent pivotal movement of the shutter beyond said angular range (C) after the pivot shaft (46) is inserted into the bearing hole (42); and anti-overstess means (40) to allow said stop means (40*a*) to resiliently yield if excessive forces are applied to the shutter (36) in an attempt to pivot the shutter beyond said angular range.

4. The electrical connector of claim 3 wherein said means includes a flexible arm (40) on the housing (12) having a stop surface (40*a*) for engaging a stop shoulder (48) on the shutter (36), the flexible arm being yieldable to form part of said anti-overstress means.

5. The electrical connector of claim 3 wherein said shutter (36) is elongated and including a pair of said bearing holes (42) and a respective pair of said pivot shafts (46) at opposite ends of the shutter.

* * * * *